United States Patent [19]

Knecht

[11] Patent Number: 4,752,245

[45] Date of Patent: Jun. 21, 1988

[54] PLUG AND RECEPTACLE REJECTION APPARATUS

[75] Inventor: George W. Knecht, Brooklyn, N.Y.

[73] Assignee: Amerace Corporation, Hackettstown, N.J.

[21] Appl. No.: 862,292

[22] Filed: May 12, 1986

[51] Int. Cl.[4] ..... H01R 13/64

[52] U.S. Cl. ..... 439/677; 439/933

[58] Field of Search ..... 439/677-679, 439/884, 894, 933, 680, 681, 695

[56] References Cited

U.S. PATENT DOCUMENTS 4,232,930 11/1980 Teti ..... 439/680

OTHER PUBLICATIONS

IBM Technical Disclosure Bulletin, "Keying Device", Bombara and Buchts, vol. 21, No. 2, Jul. 1978.

*Primary Examiner*—Gil Weidenfeld
*Assistant Examiner*—Gary F. Paumen
*Attorney, Agent, or Firm*—David Teschner

[57] ABSTRACT

A rejection apparatus adapted for selective installation in a female electrical socket to prevent mating of an incompatible male connector. The apparatus is formed of an elongated body of dielectric material and includes a segmented spherical head portion adjacent one end. The spherical head portion is designed to resiliently compress to allow insertion into a connector sleeve of the female socket. The head portion snaps outwardly into retaining engagement at an inner end or shoulder area in the sleeve. The spherical head portion also includes a shoulder which can engage an associated inner portion of the female socket to limit axial movement of the apparatus. When in position in the sleeve, the opposite end of the apparatus extends outward to function as a rejection element. The end is color coded to give a ready visual indication of the presence of a rejection apparatus in the sleeve. Also disclosed is an installation tool arranged to resiliently grasp the rejection apparatus for insertion into the connector sleeve.

15 Claims, 3 Drawing Sheets

PLUG AND RECEPTACLE REJECTION APPARATUS

BACKGROUND OF THE INVENTION

This invention pertains to the art of electrical connectors and more particularly to electrical plug and socket connectors.

The invention is particularly applicable to sleeve-type connectors and will be described with particular reference thereto; however, it will be appreciated that the invention has a broader application and may be advantageously employed in other types of connectors.

Electrical plug and socket connections generally fall into one of two major categories, namely, the NEMA-blade type, and the pin and sleeve type. Generally, the two categories are mechanically and/or electrically incompatible and mating interface between the two types, when physically possible, is undesirable and unsafe. In addition, even within the same category, mechanical and electrical incompatibilities exist and components from different manufacturers should, desirably, not be mated. The problem is further compounded by the fact that many smaller manufacturers will sometimes copy a leading manufacturers' pin diameter and hole positioning in order to provide an apparently compatible interface between the different products. Often, however, these apparently compatible products do not meet all of the standards of the original manufacturer. Therefore, even though a mating connection is possible, the resulting connection is often of poor mechanical and/or electrical quality and unsafe.

In an effort to overcome these problems, it has been deemed desirable to provide a rejection device which can function to prevent mating of incompatible connectors to assure consumers of a safe connection having good mechanical and electrical properties. The subject invention is deemed to meet these needs and overcome the above-noted problems and others.

SUMMARY OF THE INVENTION

According to the invention, there is provided a rejection apparatus that prevents electrical connection between incompatible connectors. The apparatus comprises an elongated dielectric body sized for receipt in the connector sleeve of a female electrical socket. Retaining means are provided for securing the body in the sleeve, while blocking means extend to a position to prevent electrical mating connection with an incompatible connector.

According to another aspect of the invention, the apparatus includes a surface portion which can cooperate with a portion of the female socket to define an axial limit for movement of the body into the connector sleeve.

According to another aspect of the invention, the body includes means for providing a ready, visual indication that it has been placed in the socket.

According to a further aspect of the invention, an installation tool is provided for inserting the rejection apparatus into an electrical connector. The tool includes an elongated dielectric body sized to enter the connector sleeve of the female socket. A first terminal end of the body includes means for releasably grasping the rejection apparatus with the retaining means of the apparatus extending axially outward. A handle is formed on the opposite terminal end of the dielectric body.

A principal advantage of the present invention is its ability to selectively prevent mating connection between electrical plug and socket components which are physically connectable but otherwise mechanically or electrically incompatible.

A further advantage of the invention resides in the safety and electrical integrity provided through use of such a rejection apparatus.

Yet another advantage of the invention is found in the ease with which an electrical connector socket can be equipped with a rejection apparatus.

Still other advantages and benefits of the invention will become apparent to those skilled in the art upon reading and understanding the followed detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 3:
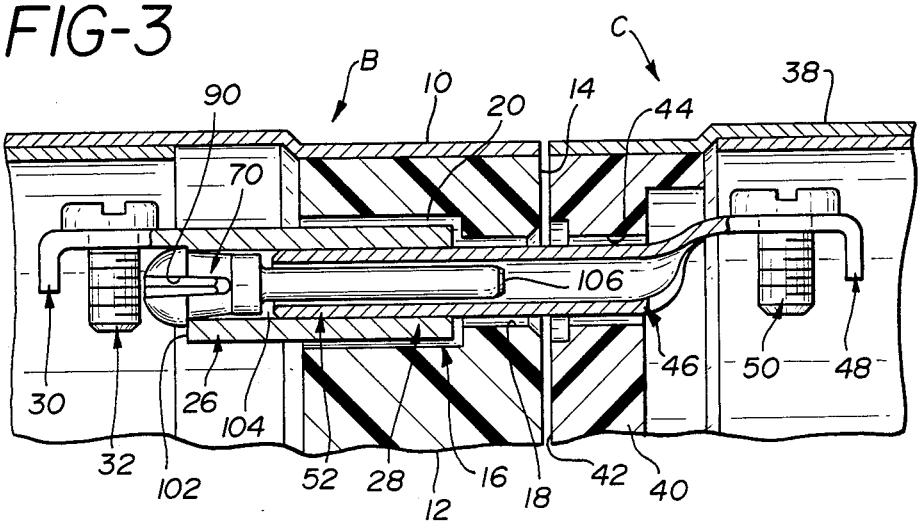
FIG. 3 is a partial, cross-sectional view of the rejection apparatus in inserted relation with a sleeve-type connector.

Referring now to the drawings wherein the showings are for purposes of illustrating the preferred embodiment of the invention only and not for purposes of limiting same, the FIGURES show a rejection apparatus or pin A formed of a dielectric or electrically non-conductive material such as a glass-filled nylon or a suitable plastic. More particularly, the rejection apparatus is adapted for insertion into a female sleeve type electrical socket B, which is adapted for mating contact with a compatible pin-type male plug C. With particular reference to FIG. 3, the female socket B includes an outer shell or housing 10 having a dielectric or electrically non-conductive material 12 disposed at one end thereof. The housing and dielectric material define a receiving or end face 14 adapted to receive the pin-type male plug C. An opening or aperture 16 extends from the end face 14 completely through the dielectric material 12 to define a plug receiving means. As shown, the opening 16 is of stepped configuration having a narrowed diameter section 18 adjacent the end face and wide diameter section 20 extending rearwardly therefrom.

The female socket includes a contact sleeve 26 that is rigidly mounted in the housing with end 28 extending into the wide diameter section 20 of the opening. A second end 30 is provided with means, such as terminal screw 32, to allow it to be connected to an associated electrical lead line.

The male plug C includes an outer housing 38 having a dielectric or electrically non-conductive material 40 disposed therein. The housing 38 and dielectric material define an end face 42 adapted for facing, mating relation with a compatible female socket B. The male plug includes an aperture or opening 44 extending through the dielectric material that closely receives and rigidly mounts a contact member 46. The inner end 48 of contact member 46 carries a terminal screw 50 for permitting connection to an associated electrical lead line. A contact member second end 52 extends generally normally outward from the end face 42 for potential mating relation with a female socket.

In a mating connection, the female socket B, particularly contact sleeve 26, closely receives the male plug C, particularly contact member 46. The contact member 46 has a cross-sectional dimension slightly less than the opening narrowed diameter section 18 of the female socket. Additionally, a contact sleeve first end 28 of the female socket has an inner dimension adapted to closely and frictionally receive the contact member second end 52 of the male plug. In a compatible female socket/male plug connection, the contact sleeve 26 and contact member 46 establish a secure mechanical, as well as electrical, connection. The end faces 14, 42 are disposed in facing relation and define the innermost receipt of the male plug in the female socket.

Figure 1:
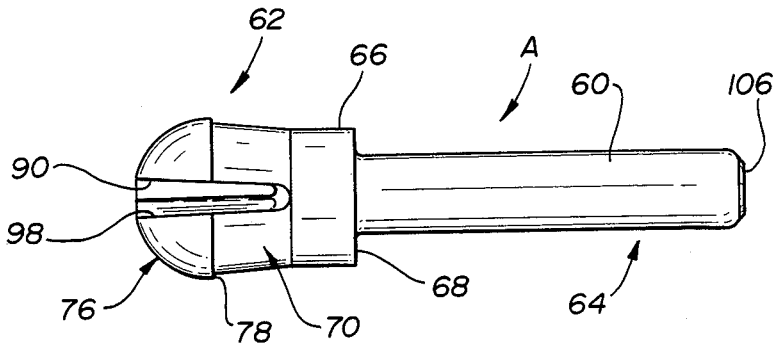
FIG. 1 is an elevational view of the rejection apparatus of the subject invention.

With continued reference to FIG. 3 and additional reference to FIGS. 1 and 2, the rejection apparatus A of the subject invention will be described in greater detail. The rejection apparatus includes an elongated body 60 having a first or retaining end 62 at one end thereof. The body is preferably generally cylindrical and has a blocking or rejection end 64 defined at the opposed end of the apparatus. The first end 62 includes a generally cylindrical section 66 of slightly greater diameter than the body 60. A generally tapered section 70 extends between cylindrical section 66 and a generally spherical head portion 76. The merging area between the tapered section and the spherical head portion defines a radially extending shoulder 78.

Figure 2:
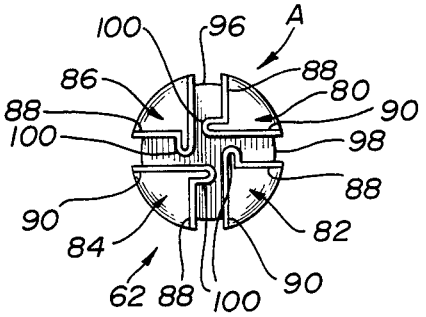
FIG. 2 is an end view of the rejection apparatus particularly illustrating the segmented configuration.

The spherical head portion 76 is arranged to be radially compressible and for this purpose the subject embodiment comprises four segment portions 80, 82, 84 and 86 (see FIG. 2). Each segment portion has a pair of radially extending faces 88, 90. The first radially extending face 88 of one segment portion is parallel and in spaced relation with the second radially extending face 90 of an associated segment portion. Moreover, axially extending and radially intersecting grooves 96, 98 extend between the parallel faces 88, 90 of the segment portions. As particularly seen in FIG. 1, the grooves extend axially from the spherical head portion 76 into the tapered cylindrical section 70 of the rejection apparatus. FIG. 2 particularly illustrates the radial intersection of the grooves 96, 98 as well as U-shaped portions 100.

Figure 5:
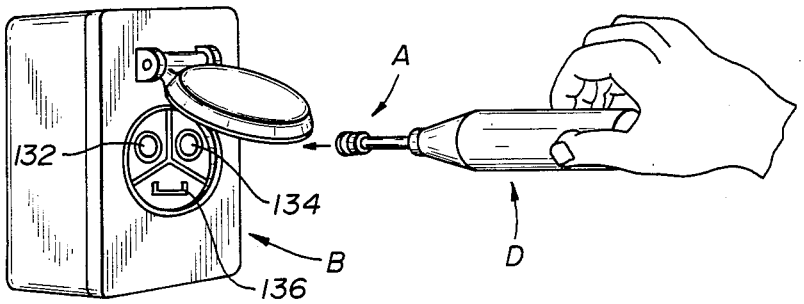
FIG. 5 is a perspective view of the rejection apparatus and associated installation tool aligned for insertion in a female socket connector.

The segment portions of the spherical surface 76 permit radial inward compression of the segment portions when forced axially into contact sleeve 26. In its normal, relaxed position the spherical head portion 76 has a diameter greater than the inner diameter of contact sleeve 26. As shown in FIGS. 3 and 5, the rejection apparatus A is centered and retainingly inserted into a female socket B. The rejection apparatus material is sufficiently resilient to allow the segment portions to move radially toward one another upon exertion of a compressive force, for example, as imposed by the reduced diameter of the contact sleeve 26.

The contact sleeve also has an inner end surface 102 adapted for operative engagement with the radial shoulder 78 of the rejection apparatus. Upon sufficient, relative axial movement between the rejection apparatus and the contact sleeve, the segment portions snap radially outwardly after passing inner end surface 102. The resiliency of the rejection apparatus material, coupled with the release of the compressive force, urges the segment portions to generally return to their original, unstressed condition. The tapered section 70 tightly engages the inner diameter of the contact sleeve once the spherical segment portions have generally attained their original configuration. The abutting engagement between shoulder 78 and end surface 102 of the contact sleeve defines a retaining means that prevents axial removal of the rejection apparatus from the contact sleeve once inserted.

The U-shaped portions 100 of the spherical head portion cooperate with the threads of terminal screw 32 at one end while the shoulder 78 abuts the inner end surface 102 of the contact sleeve. In this manner, movement of the rejection apparatus longitudinally is prohibited without requiring disassembly of the female socket B.

As illustrated in FIG. 3, a compatible male plug C is adpated for mating mechanical and electrical connection with the female socket B. The inner diameter of the contact sleeve 26 and the elongated rejection end 64 of the apparatus A define a generally annular opening 104 therebetween. It is contemplated that a compatible male plug, particularly contact member 46, may assume any of a number of configurations adapted for free receipt between the rejection apparatus and contact sleeve of the female socket. Of course, one preferred form for the compatible contact member is an annular shape having an outer diameter slightlyless than the inner diameter of the contact sleeve 26. The inner diameter of the contact member 46, in turn, must have a dimension slightly greater than the diameter of elongated body 60 of the rejection apparatus. Close fitting mechanical and electrical contact is thereby achieved between compatible members. The surface 68 of the rejection apparatus defines the innermost insertion of the male plug C into the contact sleeve 26.

Accordingly, in order that complete mating of the components can take place, shoulder or surface 68 must be located inwardly of the end face 14 a distance greater than the maximum length of contact member 46 extending outwardly from face 42.

Figure 4A:
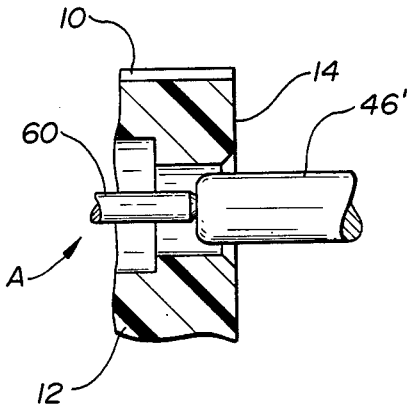
FIG. 4A is an enlarged cross-sectional view illustrating rejection of a non-compatible connector.
Figure 4B:
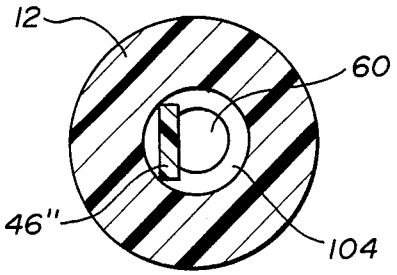
FIG. 4B is an end view illustrating rejection of an alternative non-compatible connector.

FIGS. 4A and 4B exemplify non-compatible contact members of associated male plugs. In FIG. 4A, the contact member 46' is shown as a solid pin-like construction that, in the absence of the rejection apparatus, would be closely received in the contact sleeve 26 of the female socket. More particularly, the contact sleeve 26 is disposed a first predetermined axial dimension from the end face 14. As shown in FIG. 3, the contact member 46 of a compatible male plug C must extend outwardly from end face 42 a second dimension greater than the first dimension of contact sleeve 26 relative to its end face. Additionally, the cross-sectional dimension of contact member 46 must be less than the narrow diameter section 18 of the female socket as well as the contact sleeve 26 inner diameter.

To prevent mating electrical connection between incompatible male and female connectors, the rejection end 64 of the rejection apparatus should preferably extend outwardly past the contact sleeve end 28. The apparatus rejection end 64 could conceivably extend beyond end face 14 to prevent any axial insertion of contact member 46' into opening 16, but in the preferred embodiment the rejection end 64 is axially disposed between the contact sleeve and end face. The rejection end of the apparatus, therefore, abuttingly engages the contact member 46' of a non-compatible connector and prevents further insertion into the female socket.

FIG. 4B shows an alternative contact member 46'' having a generally rectangular cross-sectional configuration. Once again, in the absence of the rejection apparatus A, this contact member 46'' could be received in contact sleeve 26 of the female socket. Since the cross-sectional configuration of contact member 46'' does not satisfy the dimensional constraints of the rejection apparatus and contact sleeve, i.e., annular opening 104, mating connection is prevented. Still other cross-sectional configurations are prevented from establishing electrical, as well as mechanical, connection between non-compatible connectors. As indicated above, only compatible connectors having a cross-sectional configuration that matches the dimensional parameters defined by the contact sleeve and rejection apparatus will be received in the female socket.

A further modification of the rejection apparatus is directed to a ready visual indication means of the rejection apparatus in a female socket. The rejection end 64 may be provided with a visual indication means such as a color coding 106 or the like. Preferably, the visual indicating means is distinct or easily contrasted with the color of the end face 14 of the female socket. For example, a female socket may utilize a material of dark brown or black color coding so that a white-tipped color coding 106 on the rejection apparatus will be easily distinguished therefrom. This readily signifies to a consumer that only a compatible male plug may be used with this female socket.

Figure 7:
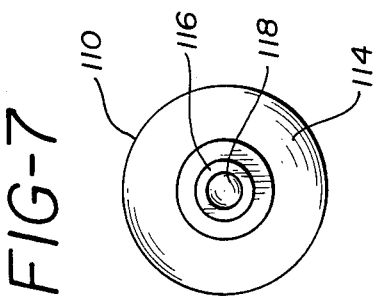
FIG. 7 is an end view of the insertion tool of FIG. 6.
Figure 6:
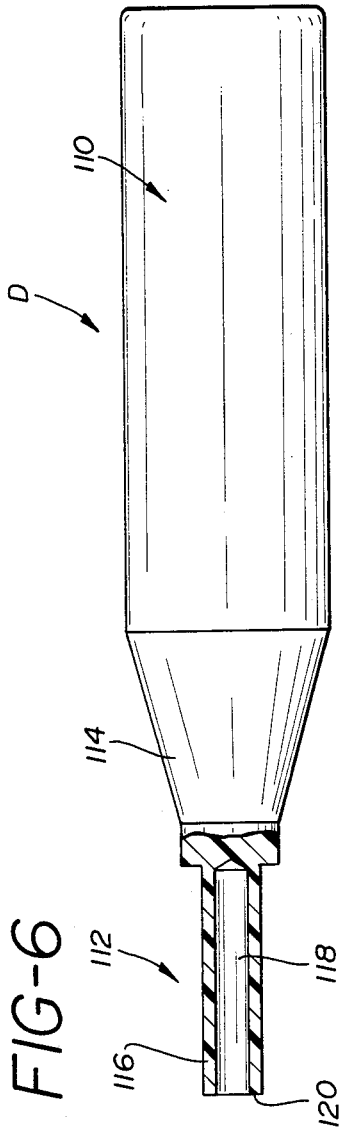
FIG. 6 is an elevational view, partially in section, of the installation tool of the subject invention.

Insertion of the rejection apparatus A into an electrical connector, such as a female wall socket, is facilitated through use of an installation tool D as shown in FIGS. 5-9. The installation tool D is formed from a dielectric or electrically insulated material. The tool includes an elongated generally cylindrical handle 110 having a releasable grasping means 112 defined at one end thereof. A tapered neck portion 114 is disposed intermediate to the handle 110 and the releasable grasping means 112 of the tool. In the embodiment of FIGS. 6 and 7, the releasable grasping means includes a tubular portion 116 having an inner diameter closely approximating the outer diameter of the elongated body 60 of the rejection apparatus. The tubular portion forms a cavity 118 adapted to releasably grasp the rejection apparatus while an outer end 120 abuts the stop surface 68 of the rejection apparatus.

A worker can insert a rejection apparatus into the releasable grasping means of the tool whereupon the spherical head portion 76 is thereafter aligned with an opening in the female socket B. Exertion of a predetermined force positions the rejection apparatus in retaining engagement with the contact sleeve 26 as described above. The insertion tool may thereafter be removed for repeated use.

Figure 9:
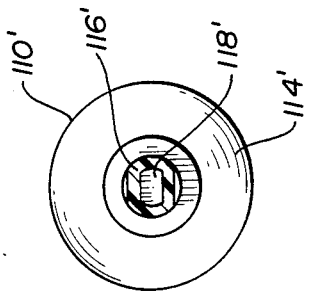
Figure 8:
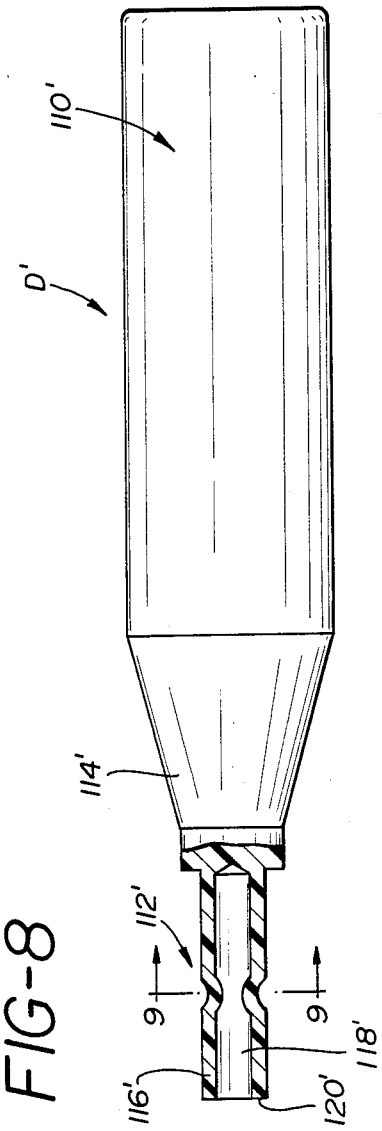
FIG. 8 is an elevational view, partially in section, of an alternative installation tool; and, FIG. 9 is a cross-sectional view generally along the lines 9—9 of FIG. 8.

An alternative insertion tool embodiment is shown in FIGS. 8 and 9 wherein like elements are identified by like numerals and new elements are identified by new numerals. The tool includes a handle 110' at one end and a releasable grasping means 112' at its opposed end. The releasable grasping means is modified and includes a depression or groove 12 formed on a tubular portion 116' of the releasable grasping means. The depressions require a predetermined force for insertion and withdrawal of the rejection apparatus into the cavity 118' of the tool. In all other respects, the alternative insertion tool embodiment is identical to the embodiment of FIGS. 6 and 7.

Typically, an electrical wall socket will have three openings or terminals. Namely, hot 132, neutral 134, and ground 136 (FIG. 5). The ground terminal 136 is oftentimes of different cross-sectional configuration than the hot and neutral terminals to assure proper orientation of the plug and socket connectors. It is possible, therefore, to use predetermined patterns to inhibit mechanical and electrical connection between incompatible connectors. For example, only the hot terminal 132 and/or the neutral terminal 134 may be provided with a rejection apparatus. The combinations may be increased through provision of a rejection apparatus for the ground terminal. Alternatively, the size and configuration of the rejection apparatus may be altered to further assure a mating connection between only compatible connectors.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A rejection apparatus adapted for preventing mating connection between a female socket and an associated non-compatible male plug set, the female socket including a contact sleeve axially disposed at a first predetermined dimension from a receiving face thereof, the male plug including a contact member extending outwardly from a first face thereof a second dimension substantially greater than said first dimension for receipt in said female contact sleeve, said rejection apparatus comprising:

an elongated dielectric body having a first end including retention means adapted for operative receipt in the associated female contact sleeve and a second end adapted for extension outwardly from the female contact sleeve; and, said body second end having blocking means for preventing mating connection of said female socket with a non-compatible male plug but allowing mating connection with a compatible male plug.

2. The rejection apparatus as defined in claim 1 wherein said retention means includes a resilient portion adapted for receipt in the female contact sleeve.

3. The rejection apparatus as defined in claim 1 wherein said retention means includes a shoulder adapted for operative engagement with the female contact sleeve.

4. The rejection apparatus as defined in claim 1 wherein said retention means further includes an arcuate surface adapted for engagement with an inner diameter of the female contact sleeve for promoting a reduction in cross-sectional dimension of said retention means.

5. The rejection apparatus as defined in claim 1 wherein said first end includes a spherically segmented portion and a shoulder adjacent thereto adapted for operative retaining engagement with the contact sleeve of said female socket.

6. The rejection apparatus as defined in claim 1 wherein said body first end has a normal, cross-sectional dimension greater than an inner dimension of the associated female contact sleeve.

7. The rejection apparatus as defined in claim 6 wherein said body first end includes means permitting it to resiliently deform to a compressed, cross-sectional dimension less than said normal cross-sectional dimension for sliding passage through the associated female contact sleeve.

8. The rejection apparatus as defined in claim 1 further comprising a surface portion for engaging a portion of the female socket and providing an axial limit for movement of said body into the contact sleeve.

9. The rejection apparatus as defined in claim 1 wherein said blocking means includes a predetermined configuration on said second end.

10. The rejection apparatus as defined in claim 1 further comprising means for providing ready visual indication of said body in the associated female socket.

11. The rejection apparatus as defined in claim 4 wherein said indication means includes a color coding on said second end.

12. In combination:

a female socket having an end face and a contact sleeve operatively communicating therewith, said contact sleeve including a first end having a retaining means thereon and a second end spaced inwardly from said end face; and, a dielectric rejection apparatus received in said contact sleeve, said rejection apparatus including a first end retainingly held in said contact sleeve and a second end extending outwardly therefrom to a position spaced intermediate said end face and said contact sleeve second end whereby said rejection apparatus second end inhibits mating connection between said female socket and an associated non-compatible male plug.

13. The combination as defined in claim 12 wherein said rejection apparatus includes blocking means adjacent said second end for preventing mating connection between said female socket and an associated non-compatible male plug.

14. The combination as defined in claim 13 wherein the blocking means is generally centrally aligned with said contact sleeve.

15. The combination as defined in claim 13 wherein said blocking means includes a pin member having a cross-sectional dimension substantially less than an inner diameter of the contact sleeve whereby said pin member and contact sleeve generally define an annulus therebetween.

* * * * *

UNITED STATES PATENT AND TRADEMARK OFFICE

CERTIFICATE OF CORRECTION

PATENT NO. : 4,752,245

DATED : June 21, 1988

INVENTOR(S) : George W. Knecht

It is certified that error appears in the above—identified patent and that said Letters Patent is hereby corrected as shown below:

Col. 6, line 10, change the numeral "12" to --122--.

Signed and Sealed this

Twenty-ninth Day of May, 1990

*Attest:*

HARRY F. MANBECK, JR.

*Attesting Officer*

*Commissioner of Patents and Trademarks*